US006948830B1

(12) United States Patent
Petrick

(10) Patent No.: US 6,948,830 B1
(45) Date of Patent: Sep. 27, 2005

(54) DUAL BEACON OBSTRUCTION LIGHTING SYSTEM

(76) Inventor: John T. Petrick, 11255 Osceola Dr., New Port Richey, FL (US) 34654

( * ) Notice: Subject to any disclaimer, the term of this patent is extended or adjusted under 35 U.S.C. 154(b) by 0 days.

(21) Appl. No.: 10/757,082

(22) Filed: Jan. 14, 2004

(51) Int. Cl.[7] ..... F21S 19/00
(52) U.S. Cl. ..... 362/229; 362/228; 362/336
(58) Field of Search ..... 362/227–229, 362/336

(56) References Cited

U.S. PATENT DOCUMENTS

| | | | | | |
|---|---|---|---|---|---|
| 516,824 | A | * | 3/1894 | Knowles | 362/240 |
| 1,732,745 | A | * | 10/1929 | Erskine | 362/227 |
| 1,961,116 | A | * | 5/1934 | Van Braam Van | 362/220 |
| 2,165,211 | A | * | 7/1939 | Bass et al. | 362/228 |
| 4,360,862 | A | * | 11/1982 | Strasser et al. | 362/477 |
| 4,727,289 | A | * | 2/1988 | Uchida | 315/71 |
| 4,912,334 | A | * | 3/1990 | Anderson | 250/495.1 |
| 4,920,301 | A | * | 4/1990 | Crooks | 315/241 S |
| 4,984,142 | A | * | 1/1991 | Garnerone | 362/249 |
| 5,152,601 | A | * | 10/1992 | Ferng | 362/183 |
| 5,155,666 | A | * | 10/1992 | Radford et al. | 362/145 |
| 5,224,773 | A | * | 7/1993 | Arimura | 362/227 |
| 5,567,036 | A | * | 10/1996 | Theobald et al. | 362/485 |
| 5,585,783 | A | * | 12/1996 | Hall | 340/473 |
| 5,685,637 | A | * | 11/1997 | Chapman et al. | 362/263 |
| 5,806,965 | A | * | 9/1998 | Deese | 362/249 |
| 5,984,494 | A | * | 11/1999 | Chapman et al. | 362/470 |
| 6,013,985 | A | * | 1/2000 | Green et al. | 315/149 |
| 6,070,994 | A | * | 6/2000 | Sebek et al. | 362/332 |
| 6,099,148 | A | * | 8/2000 | Northrup et al. | 362/336 |
| 6,183,100 | B1 | * | 2/2001 | Suckow et al. | 362/35 |
| 6,425,678 | B1 | * | 7/2002 | Verdes et al. | 362/244 |
| 6,483,254 | B2 | * | 11/2002 | Vo et al. | 315/241 S |
| 6,491,417 | B1 | * | 12/2002 | Haen et al. | 362/485 |
| 6,525,668 | B1 | * | 2/2003 | Petrick | 340/815.45 |
| 6,626,557 | B1 | * | 9/2003 | Taylor | 362/249 |
| 2002/0122309 | A1 | * | 9/2002 | Abdelhafez et al. | 362/294 |
| 2003/0142495 | A1 | * | 7/2003 | Nakao | 362/261 |
| 2004/0095777 | A1 | * | 5/2004 | Trenchard et al. | 362/477 |

* cited by examiner

*Primary Examiner*—Stephen Husar
*Assistant Examiner*—Jason Han
(74) *Attorney, Agent, or Firm*—Edward P. Dutkiewicz

(57) ABSTRACT

A white light generating portion is comprised of a gas discharge light source and a rotated cylindrical lens. A red light generating portion is comprised of a plurality of light emitting diodes.

1 Claim, 7 Drawing Sheets

DUAL BEACON OBSTRUCTION LIGHTING SYSTEM

BACKGROUND OF THE INVENTION

1. Field of the Invention

The present invention relates to a dual beacon obstruction lighting system and more particularly pertains to providing both light emitting diode emissions and gas energy emissions.

2. Description of the Prior Art

The use of obstruction lighting of known designs and configurations is known in the prior art. More specifically, obstruction lighting of known designs and configurations previously devised and utilized for the purpose of obstructing light through known methods and apparatuses are known to consist basically of familiar, expected, and obvious structural configurations, notwithstanding the myriad of designs encompassed by the crowded prior art which has been developed for the fulfillment of countless objectives and requirements.

By way of example, note U.S. Pat. No. 6,425,678 issued Jul. 30, 2002 to Verdes and relating to an LED obstruction lamp.

While these devices fulfill their respective, particular objectives and requirements, the aforementioned patents do not describe a dual beacon obstruction lighting system that allows providing both light emitting diode emissions and gas energy emissions.

In this respect, the dual beacon obstruction lighting system according to the present invention substantially departs from the conventional concepts and designs of the prior art, and in doing so provides an apparatus primarily developed for the purpose of providing both light emitting diode emissions and gas energy emissions.

Therefore, it can be appreciated that there exists a continuing need for a new and improved dual beacon obstruction lighting system which can be used for providing both light emitting diode emissions and gas energy emissions. In this regard, the present invention substantially fulfills this need.

SUMMARY OF THE INVENTION

In view of the foregoing disadvantages inherent in the known types of obstruction lighting of known designs and configurations now present in the prior art, the present invention provides an improved dual beacon obstruction lighting system. As such, the general purpose of the present invention, which will be described subsequently in greater detail, is to provide a new and improved dual beacon obstruction lighting system and method which has all the advantages of the prior art and none of the disadvantages.

To attain this, the present invention essentially comprises a lower portion. The lower portion has a cylindrical configuration. The lower portion has an upper open end and a lower open end. A periphery is provided between the upper and lower ends. A lower baffle plate is provided. The lower baffle plate supports the lower open end. The lower open end has a gas discharge light source. The gas discharge light source generates white light. The gas discharge light source is coupled to the lower baffle plate. The lower portion has a second baffle plate. The second baffle plate has a central aperture to allow heat circulation located in the upper open end. The periphery is comprised of a Fresnel lens. The Fresnel lens forms a rotated cylindrical lens. The rotated cylindrical lens is devised to capture a maximal portion of substantially omni directional light from the gas discharge light source.

A red light generating upper portion is provided. The upper portion has a cylindrical configuration. The upper portion has an open upper end, an open lower end and a periphery between the upper and lower ends. The open lower end is adjacent to the second baffle plate. The periphery is comprised of a translucent red material. The upper light emitting portion further has a cylinder. The cylinder has three rows of a plurality of equally spaced light emitting solid state diodes. A central aperture is provided in the cylinder to allow cooling of the upper light emitting portion.

Provided next is a cylindrical cover. The cylindrical cover has a screen. The screen is coupled to the open upper end of the upper portion. A central screened portion is adapted to allow venting of the upper and lower portions.

The gas discharge light source of the lower portion as well as the plurality of light emitting diodes of the upper portion are adapted to be electrically coupled to an external energy source. In this manner the lower portion produces brilliant white flashes of light during the daytime hours and the upper portion produces red flashes of light during the night time hours.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dual beacon obstruction lighting system which has all of the advantages of the prior art obstruction lighting of known designs and configurations and none of the disadvantages.

It is another object of the present invention to provide a new and improved dual beacon obstruction lighting system which may be easily and efficiently manufactured and marketed.

It is further an object of the present invention to provide a new and improved dual beacon obstruction lighting system which is of durable and reliable constructions.

An even further object of the present invention is to provide a new and improved dual beacon obstruction lighting system which is susceptible of a low cost of manufacture with regard to both materials and labor, and which accordingly is then susceptible of low prices of sale to the consuming public, thereby making such dual beacon obstruction lighting system economically available to the buying public.

Even still another object of the present invention is to provide a dual beacon obstruction lighting system for providing both light emitting diode emissions and gas energy emissions.

Lastly, it is an object of the present invention to provide a new and improved dual beacon obstruction lighting system. A white light generating portion is comprised of a gas discharge light source and a rotated cylindrical lens. A red light generating portion is comprised of a plurality of light emitting diodes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
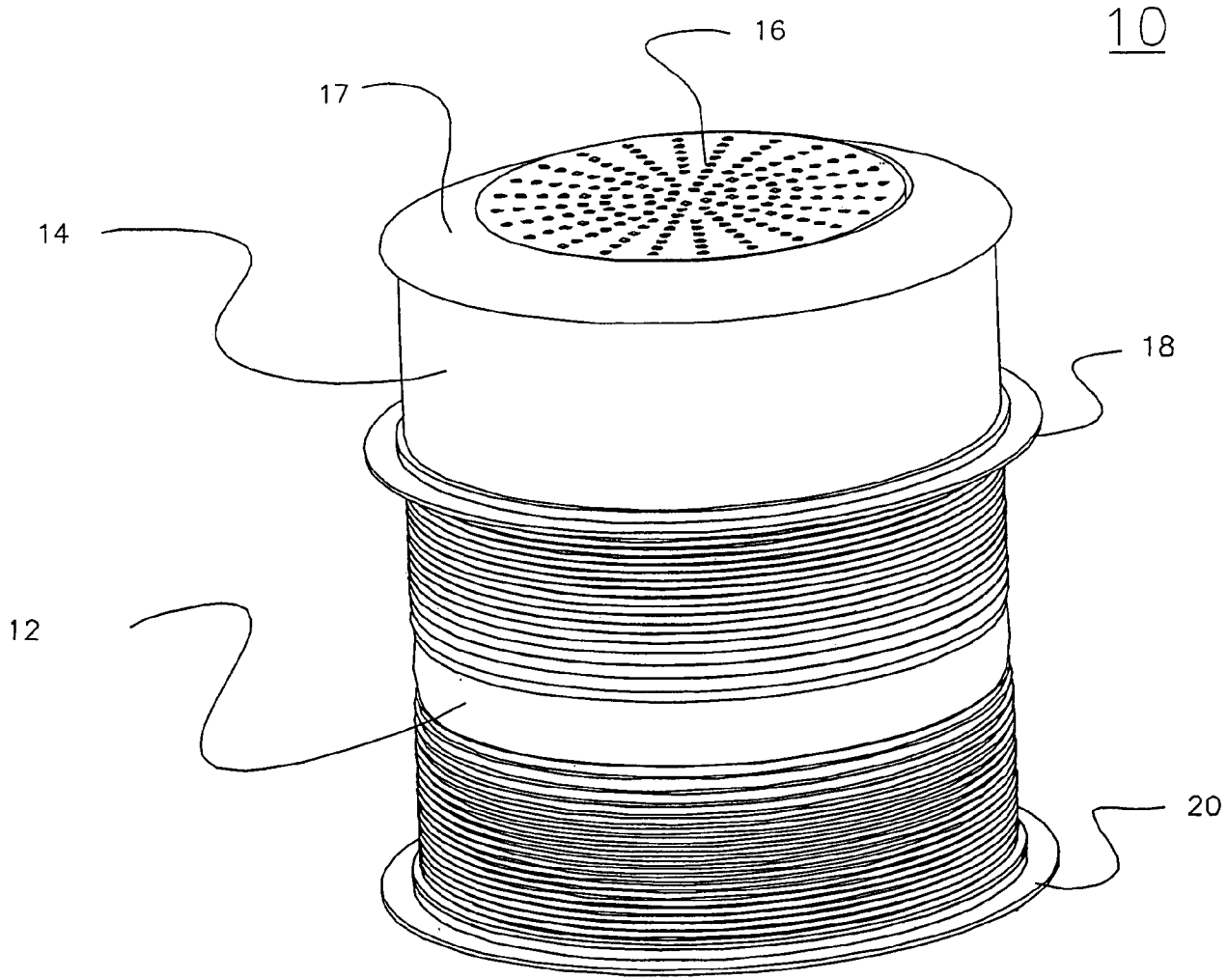
FIG. 1 is a perspective illustration of a dual beacon obstruction lighting system constructed in accordance with the principles of the present invention.

With reference now to the drawings, and in particular to FIG. 1 thereof, the preferred embodiment of the new and improved dual beacon obstruction lighting system embodying the principles and concepts of the present invention and generally designated by the reference numeral 10 will be described.

The present invention, the dual beacon obstruction lighting system 10 is comprised of a plurality of components. Such components in their broadest context include a white light generating portion and a red light generating portion. Such components are individually configured and correlated with respect to each other so as to attain the desired objective.

First provided is a lower portion 12. The lower portion has a cylindrical configuration. The lower portion has an upper open end and an lower open end. A periphery is provided between the upper and lower ends.

A lower baffle plate 20 is provided. The lower baffle plate supports the lower open end. The lower open end has a gas discharge light source 22. The gas discharge light source generates white light. The gas discharge light source is coupled to the lower baffle plate 20. Above the lower portion is an upper baffle plate 18. The upper baffle plate has a central aperture to allow heat circulation located in the upper open end. The periphery of the lower portion is comprised of a Fresnel lens 24 in the central extent. The Fresnel lens forms a rotated cylindrical lens. The rotated cylindrical lens is devised to capture a maximal portion of substantially omni directional light from the gas discharge light source.

A red light generating upper portion 14 is provided. The upper portion has a cylindrical configuration to be received over the upper extent, a transparent cover, of the lower portion. The upper portion has an open upper end, an open lower end and a periphery between the upper and lower ends. The open lower end includes the upper baffle plate 18. The periphery is comprised of a translucent red material. The upper light emitting portion further is a cylinder with three rows of a plurality of equally spaced light emitting solid state diodes 30 in each row. A central aperture is provided in the cylinder to allow cooling of the upper light emitting portion.

Provided next is cylindrical cover 17. The cylindrical cover has a screen 16. The screen is coupled to the open upper end 31 of the upper portion. A central screened portion is adapted to allow venting of the upper and lower portions.

The gas discharge light source of the lower portion as well as the plurality of light emitting diodes of the upper portion are adapted to be electrically coupled to an external energy source. In this manner the lower portion produces brilliant white flashes of light during the daytime hours and the upper portion produces red flashes of light during the night time hours.

Figure 2:
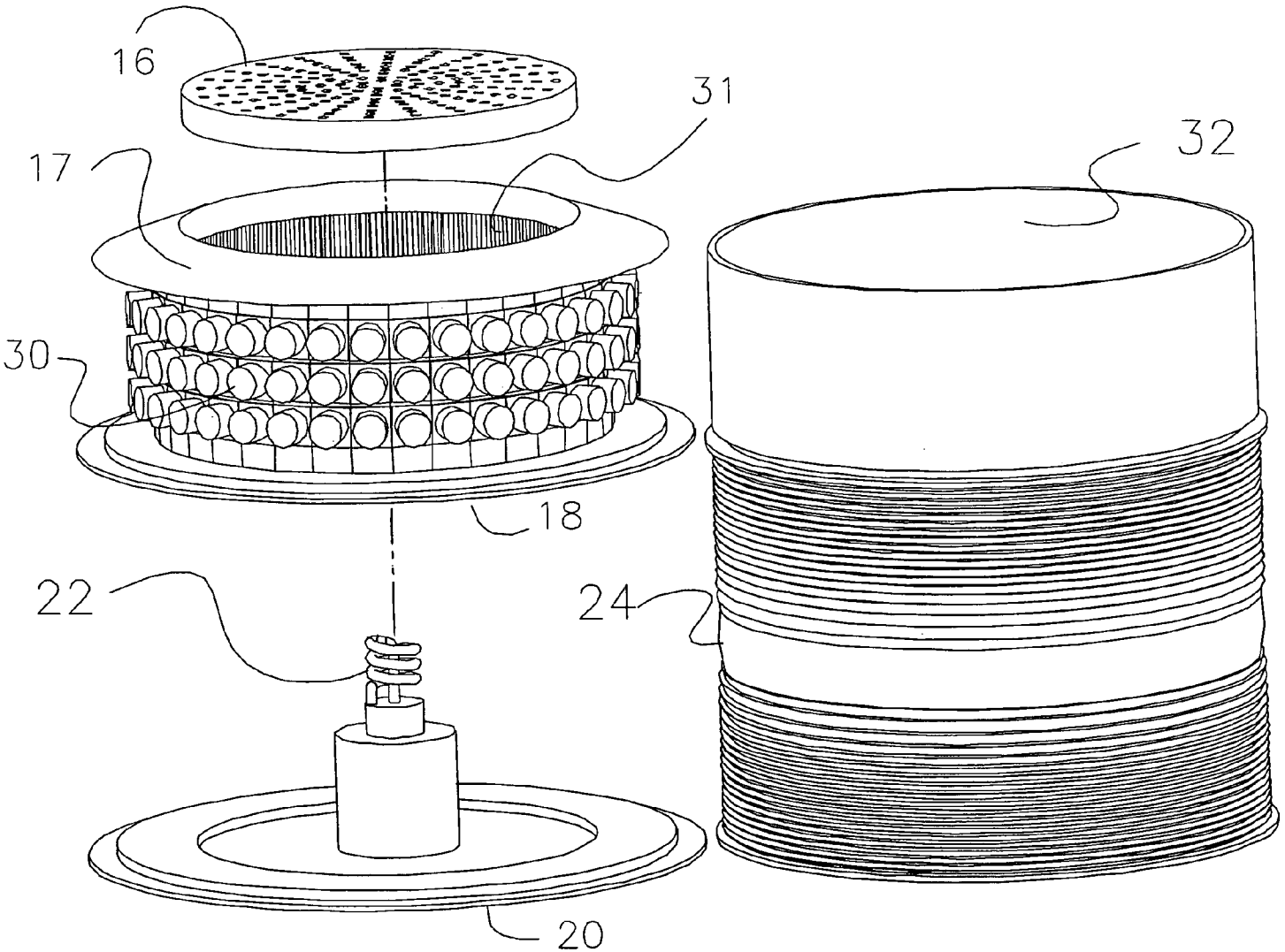
FIG. 2 is an exploded perspective view of the system shown in FIG. 1.

The dual beacon obstruction light using LED and gas discharge sources of the present invention is a substantial improvement over the prior art structures in that it combines a highly efficient LED light source with a conventional white xenon gas discharge strobe light to generate a visual warning for aircraft in both daytime and nighttime conditions exhibiting low power and high longevity. See FIGS. 1 and 2.

The invention comprises a lower light emitting portion 12 and an upper light emitting portion 14. A screen 16 and a cover 17 are employed to prevent wildlife and debris entry into any free space in portion 14 while permitting convective heat exchange with the environment. Baffle plates 18 and 20 are used for mounting and to preclude optical communication between the upper and lower portions 12 and 14.

Figure 3:
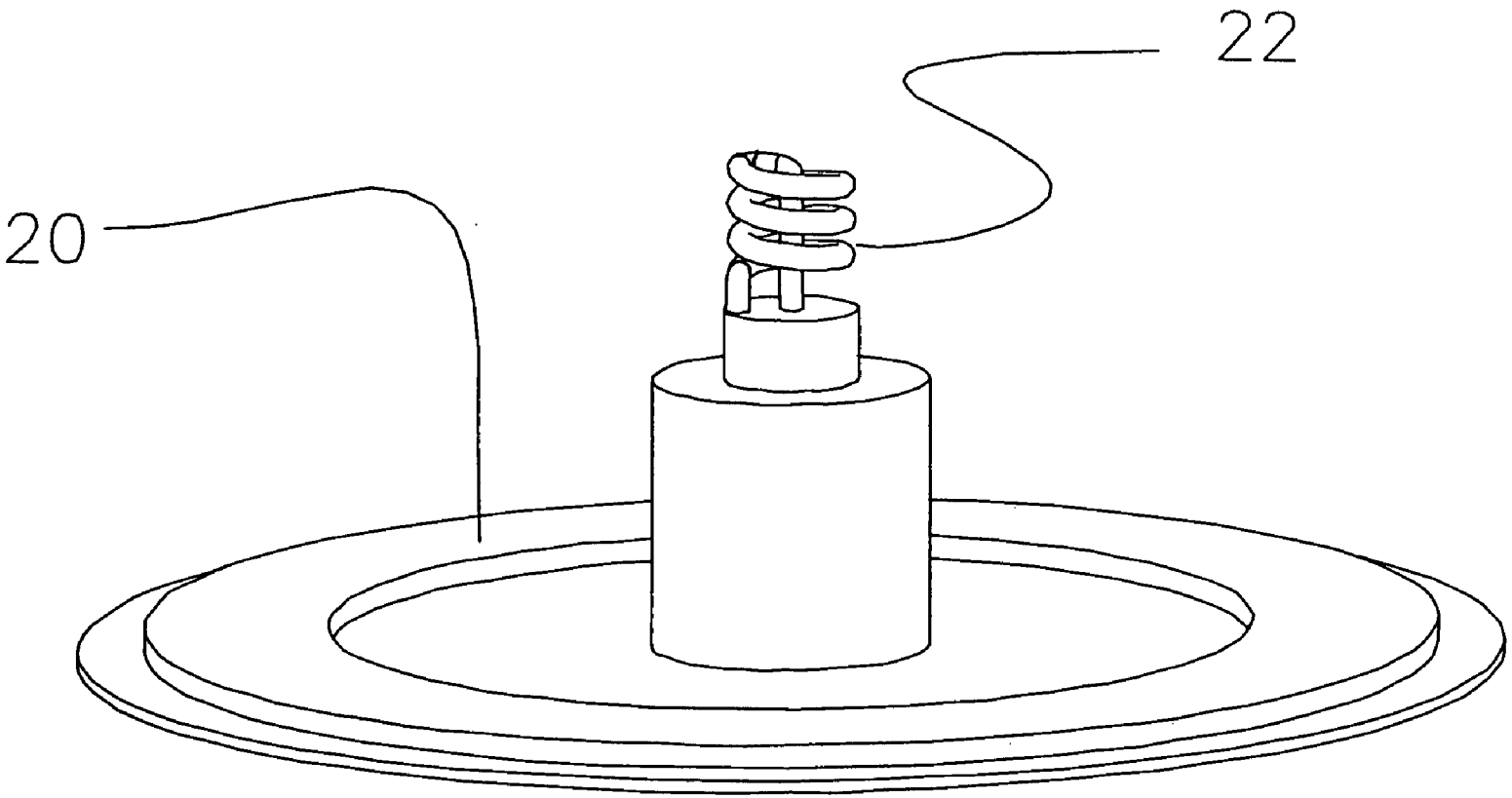
FIG. 3 is a perspective illustration of the gas discharge light source and associated components shown in FIG. 2.
Figure 4:
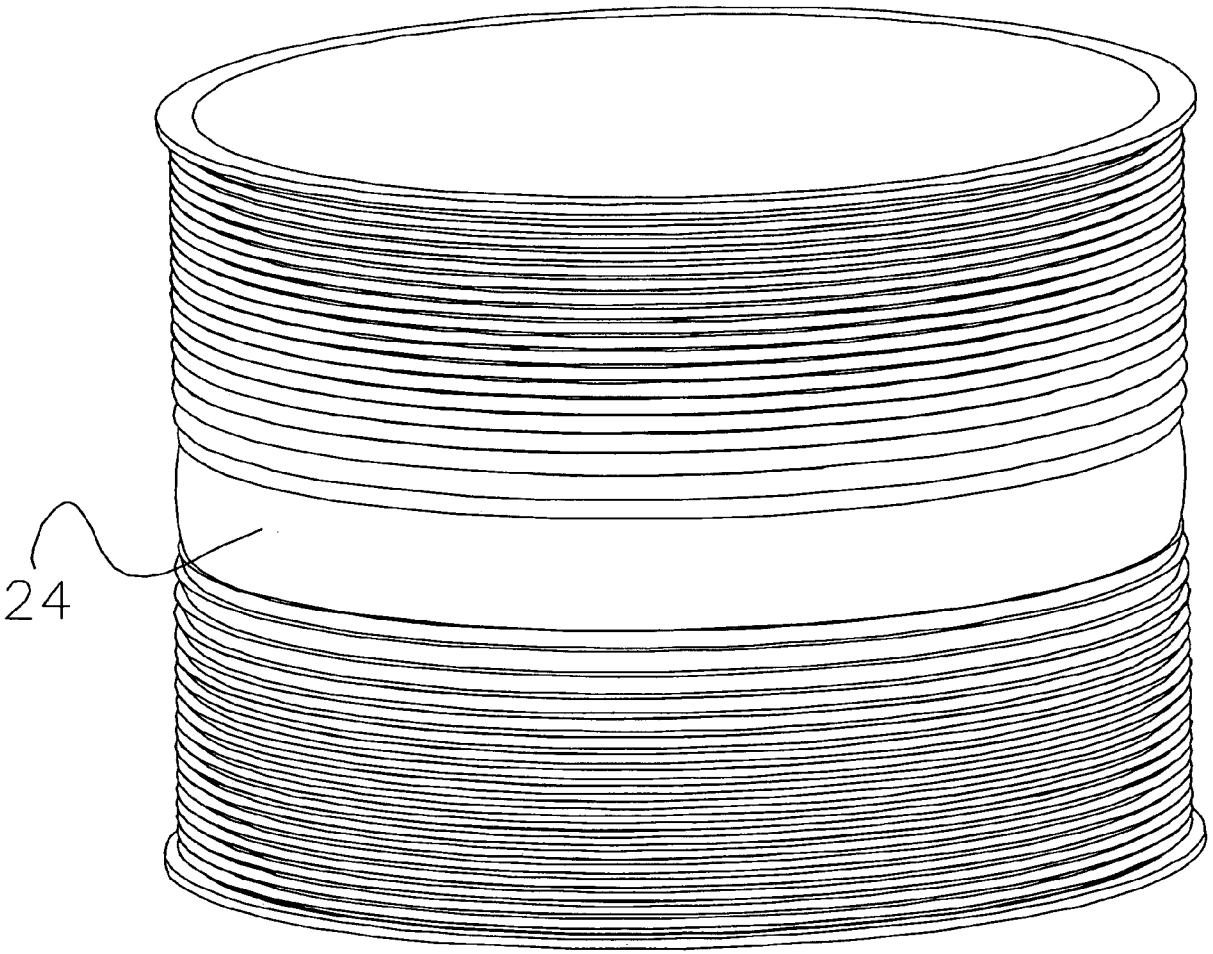
FIG. 4 is a perspective illustration of the lens shown in FIGS. 1 and 2.
Figure 5:
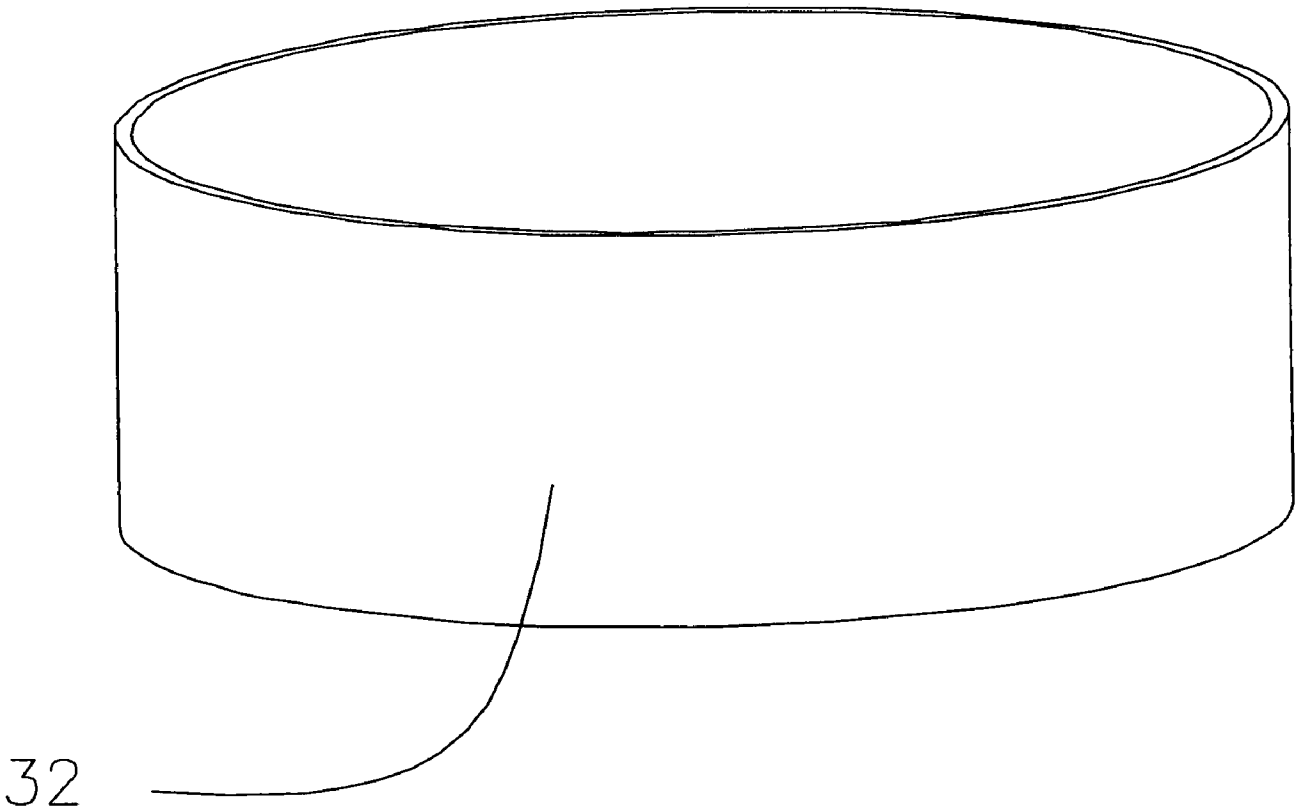
FIG. 5 is a perspective illustration of the cover shown in FIGS. 1 and 2.
Figure 6:
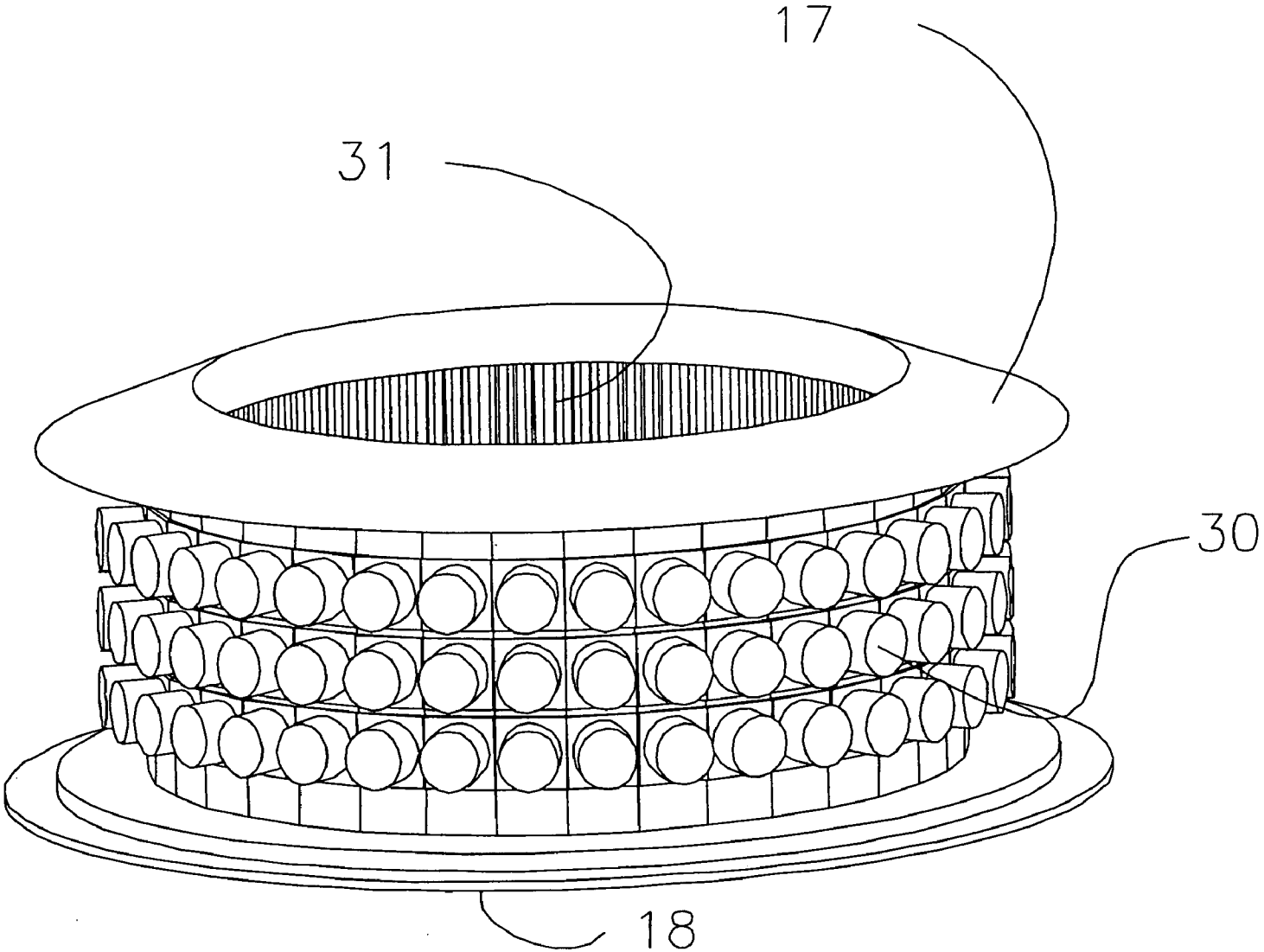
FIG. 6 is a perspective illustration of the light emitting diode (LED) light source and associated components shown in FIG. 2.
Figure 7:
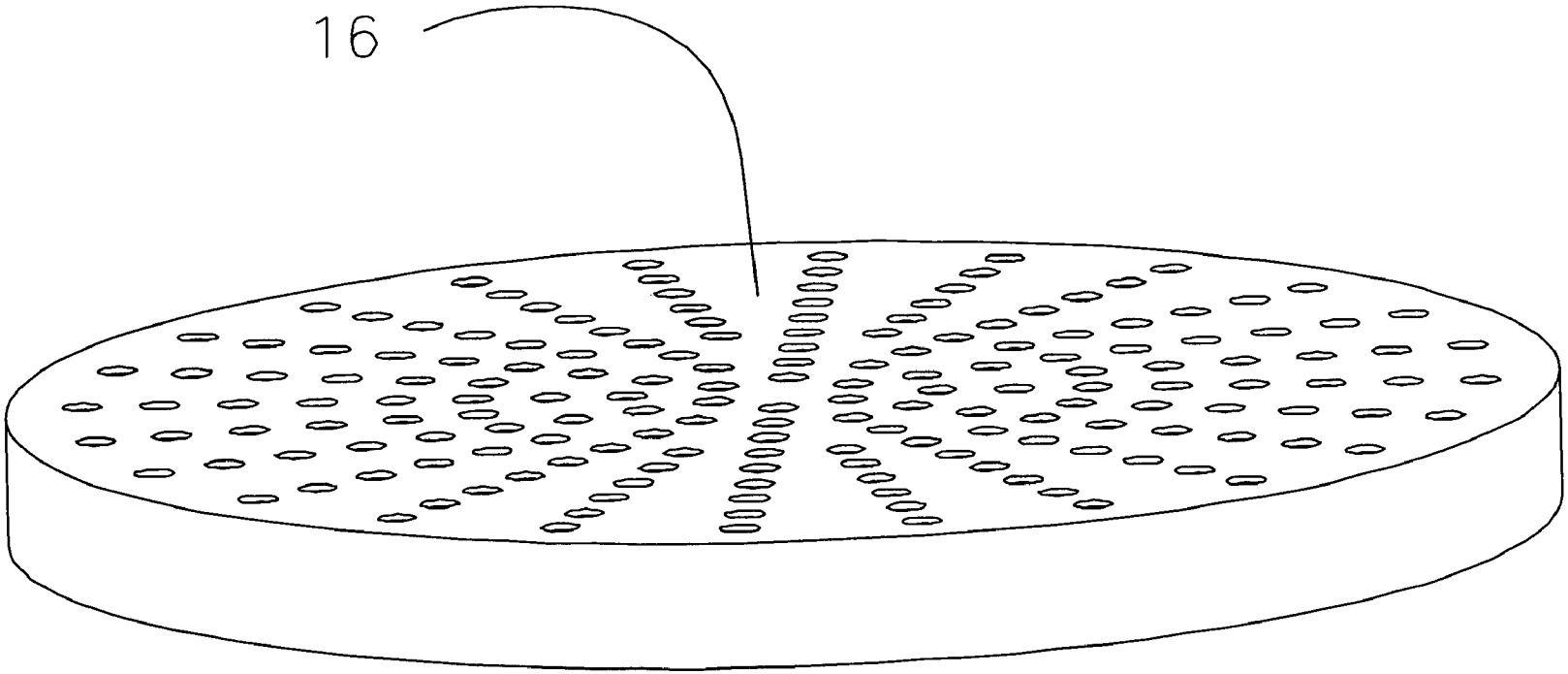
FIG. 7 is a perspective illustration of the screen shown in FIGS. 1 and 2.

The lower light emitting portion 12 comprises a gas discharge light source 22 generally powered by an electrical source and a Fresnel lens 24. Upper light emitting portion 14, in the preferred embodiment, comprises a plurality of light emitting diode (LED) light sources 30 generally powered by an external electrical source, a heat exchanger means 31 for cooling the LEDs 30, and a translucent protective cover shown as lens 32. See FIG. 3. FIG. 3 is an exploded view showing screen 16 displaced along the light axis, and lenses 24 and 32 displaced orthogonally for clarity. Fresnel lens 24 is translucent at all visible wavelengths to permit an intense emission of white light flashes for daytime obstruction conspicuousness.

Lens 24 is devised to capture a maximum portion of substantially omni directional light from light source 22 and to further form this light into a fan subtending 360 degrees in azimuth and from 3–7 degrees in elevation centering on the horizontal. The form of lens 24 is generally a rotated cylindrical lens of the Fresnel type. This light is required by the FAA to reach 20,000 cd maximum output and drop by not more than 50 percent throughout the 3–7 degree azimuth range.

The translucent cover 32 may be absent if the LEDs 30 are sufficiently robust. Alternatively, the cover 32 may form a simple protective cover or lens. As a lens, cover 32 may be of a rotated Fresnel or simple type, or only a lenticular array of vertically disposed flutes may be employed to facilitate azimuthal light distribution. The cover 32 is devised to maximally transmit light in a red wavelength region as required by the FAA for the L-864 obstruction light. The visual appearance of cover 32 may be clear or red. The appearance of lens 24 will be substantially clear or may have a yellow cast if UV protective or yellow shifting dyes are incorporated in the lens base material for the purpose of anti-degradation or efficacy enhancement respectively.

LED light source 30 comprises a plurality of red emitting solid state light emitting diodes with an associated optical system, which, in combination with any lens properties of cover 32, produces a fan of red light subtending 360 degrees in azimuth and from 3–7 degrees in elevation centering on the horizontal. The peak output of this light is required to reach 2,000 cd and is not permitted to drop by more than 50 percent of the peak value throughout the 3–7 degree azimuth range.

The lower light emitting portion 12 and the upper light emitting portion may be reversed having the gas discharge source 22 and lens 24 positioned above LED light source 30.

In operation, white light source 22 is energized during daytime conditions to produce a brilliant white flashing light thereby improving the conspicuousness of a tower or other potential obstruction to aircraft. At night, the brilliant white flashes would be overpowering and a reduced output is desired. In some prior art devices, the same white producing source 22 is employed at reduced flash energy to indicate the presence of an obstruction. However, the use of white lights at night is unfavorable since these lights are annoying to area residents and are believed to adversely affect the nocturnal habits of wildlife. Therefore, a red flashing light is preferred for night operation.

Some prior art structures employ one or more xenon gas discharge lamps to generate both the white daytime flashes and the red nighttime flashes. Operating a white light source 22 with a red filter lens either surrounding the source 22 or intrinsic to the Fresnel lens 24 comprises the prior art in red light production for nighttime obstruction lighting. Unfortunately the xenon gas discharge source 22 is burdened with producing more light in the blue spectral region, which is removed by the filter to produce the requisite red light. The impact of this filtering is very poor overall efficiency with significant heat removal problems.

Employing LEDs 30 to generate the required red light for nighttime obstruction lighting enhances efficiency resulting in electrical energy consumption of less than half the energy required for the gas discharge versions. LEDs 30 are also considered high longevity devices having average lifetimes reaching 30,000–100,000 hours. Employing the LEDs 30 in combination with the daytime only operation of gas discharge source 22 results in replacement maintenance of only one item, source 22, thereby reducing routine maintenance cost by hundreds of dollars per lamp replacement as well as extending the Mean Time Between Maintenance (MTBM) by a significant amount.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A dual beacon obstruction lighting system for providing both light emitting diode emissions and gas energy emissions comprising, in combination:

a lower portion having a cylindrical configuration with an upper open end and an lower open end and a periphery there between and a lower baffle plate supporting the lower open end with a gas discharge light source for generating white light, the gas discharge light source being coupled to the lower baffle plate, the lower portion having an upper baffle plate with a central aperture to allow heat circulation located in the upper open end, the periphery of the lower portion being comprised of a Fresnel lens forming a rotated cylindrical lens in the central extent devised to capture a maximal portion of substantially omni directional light from the gas discharge light source;

a red light generating upper portion having a cylindrical configuration received over the upper extent of the lower portion and with an open upper end, an open lower end and a periphery there between with the open lower end including the upper baffle plate, the periphery being comprised of a translucent red material, the upper light emitting portion further having a cylinder with a plurality of rows of a plurality of equally spaced light emitting solid state diodes in each row and having a central aperture in the cylinder to allow cooling of the upper light emitting portion;

a cylindrical cover with a screen coupled to the open upper end of the upper portion with a central screened portion adapted to allow venting of the upper and lower portions; and the gas discharge light source of the lower portion as well as the plurality of light emitting diodes of the upper portion adapted to be electrically coupled to an external energy source such that during day light hours the lower portion produces brilliant white flashes of light and during the night time hours the upper portion produces red flashes of light.

* * * * *